US005555084A

United States Patent [19]

Vetromile et al.

[11] Patent Number: 5,555,084

[45] Date of Patent: Sep. 10, 1996

[54] APPARATUS FOR SHEET TO IMAGE REGISTRATION

[75] Inventors: Joseph S. Vetromile, Brighton; Lawrence R. Benedict, Rushville, both of N.Y.

[73] Assignee: Xerox Corporation, Stamford, Conn.

[21] Appl. No.: 520,345

[22] Filed: Aug. 28, 1995

[51] Int. Cl.[6] ..... G03G 15/00

[52] U.S. Cl. ..... 355/317; 355/208

[58] Field of Search ..... 355/317, 208; 347/153; 395/111

[56] References Cited

U.S. PATENT DOCUMENTS 4,519,700 5/1985 Barker et al. ..... 347/153 X 4,971,304 11/1990 Lofthus ..... 271/227

5,394,223 2/1995 Hart et al. ..... 355/212

*Primary Examiner*—Joan H. Pendegrass

*Assistant Examiner*—Quana Grainger

*Attorney, Agent, or Firm*—H. Fliescher; J. E. Beck; R. Zibelli

[57] ABSTRACT

An apparatus for registering a sheet with a developed image on a moving surface. The apparatus includes a transfer station, detector, memory, and a registration transport. The detector is located at the transfer station and generates a registration signal in response to a sheet edge and a registration portion of the developed image. The memory stores sheet position factors and responds to the detector to update the factors. The registration transport communicates with the detector and the memory to move the sheet to the transfer station in registration with the developed image.

20 Claims, 9 Drawing Sheets

APPARATUS FOR SHEET TO IMAGE REGISTRATION

This invention relates generally to controlling a moving sheet so that a developed image on a moving surface is transferred thereto in registration.

Critical control of sheet to image registration is required in a duplex printing machine having more than one process station to produce an image on image color output in a single pass of the photoconductive belt. This also true for a multi-pass system, whereby successive color images are applied in subsequent belt passes. Failure to achieve proper sheet-to-image registration yields printed copies on which images are misaligned. The misaligned images are generally obvious upon viewing. With single sided (simplex) printing, they usually exhibit fuzzy color separations, bleeding, and/or other errors that make the copies unsuitable for their intended use.

For duplex printing, identical images are registered on the front and back side of a single copy sheet. Specifically, the first image (appearing on the front or simplex side), and the second image (appearing on the back or duplex side), are positioned so that they are coincident. In other words, the two images form a mirror image since each is printed with no apparent offset. The oppositely posed images appear to be in perfect or transparent registration when they are accurately positioned on their separate side of the sheet.

Heretofore, achieving offset print quality with an electrophotographic printing machine has been difficult. A simple, relatively inexpensive, and accurate approach is provided by tracking sheet to image registration on the photoconductive surface. It is accomplished by an active sheet-to-image registration system. The active sheet-to-image registration system has long been a goal in the design, manufacture, and use of electrophotographic printing machines. The need has been particularly recognized in the color and highlight color portion of electrophotography, and has become more acute as the demand for high quality, low cost color imaging has increased.

Techniques for registering paper and registering images on photoconductive belts have hereinbefore been devised as illustrated by the following disclosures, which may be relevant to certain aspects of the present invention.

U.S. Pat. No. 5,394,223

Patentee: Hart et al.

Issued: Feb. 28, 1995

U.S. Pat. No. 4,971,304

Patentee: Robert M. Loftus

Issued: Nov. 20, 1990

The disclosure of the above-identified patents may be briefly summarized as follows:

U.S. Pat. No. 5,394,223 discloses an electrophotographic printing machine employing an image registration system to produce an image on image color output. The registration system tracks a moving photoconductive belt so that images are registered in the process and lateral directions, and for skew position. Target marks consisting of a developed array of lines perpendicular to each imager axis are placed adjacent to images on the belt. The marks are detected by light sensitive sensors located on each imager so as to measure process and lateral registration. Registration in the process direction begins when the sensor on a subsequent imager scans for the presence of target marks laid down by a preceding imager. Lateral registration is established by scanning the illumination of the target marks along the axis of the subsequent imager with the sensor mounted thereon and determining the position of the maximum or minimum light signal. Skew measurement is achieved with at least two more sensors positioned at the inboard and outboard edges of the belt. Timing marks are correspondingly placed on the belt by the preceding imager and detected by the skew sensors at the subsequent imager. Any variation in arrival time between the inboard and outboard marks indicates a skew position that must be corrected.

U.S. Pat. No. 4,971,304 discloses an edgeless sheet registration system suitable for an electrophotographic printing machine. The registration system transports a sheet to a transfer zone, wherein the edges of the sheet are synchronized with an image developed on a photoconductive belt. Sheet registration is accomplished in the process and lateral directions, as well as for skew position. The sheet velocity is also matched to the velocity of the belt. In operation, two separate motors drive the sheet non-differentially in the process direction. The sheet is driven until it reaches two optical sensors which detect passage of selected sheet portions thereby. Signals from the sensors are communicated to a controller, wherein the time difference between passage of the selected sheet portions is used to compensate the random skew. Compensation is achieved by the controller driving the motors differentially so as to guide sheet into a preselected skew magnitude. The motors continue to run differentially to compensate for the induced skew until a side edge of the sheet is detected by a third sensor. Detection by the third sensor establishes registration in the lateral direction. Thereafter, the motors again run in a non-differential mode to drive the sheet in the process direction. A fourth sensor located downstream, along the path of travel, is provided to detect the time of passage of the registered sheet thereby.

In accordance with one aspect of the invention, there is provided an apparatus for registering a sheet with a developed image on a moving surface. The apparatus includes a transfer station, and a detector located thereat. The detector is responsive to an edge of the sheet and a registration portion of the developed image to generate a registration signal. A memory stores sheet position factors. The memory is responsive to the registration signal from the detector to update the sheet position factors. The registration transport communicates with the detector and memory to move the sheet to the transfer station in registration with the developed image.

In accordance with another aspect of the invention there is provided, a printing machine of the type in which a sheet is registered with a developed image on a moving surface. The machine includes a transfer station and a detector located thereat. The detector is responsive to an edge of the sheet and a registration portion of the developed image to generate a registration signal. A memory stores sheet position factors. The memory is responsive to the registration signal from the detector to update the sheet position factors. The registration transport communicates with the detector and memory to move the sheet to the transfer station in registration with the developed image.

In accordance with yet another aspect of the invention, there is provided a method of registering a sheet with a developed image on a moving surface. At the transfer station, an edge of the sheet and a registration portion of the developed image is detected. A registration signal is generated. Sheet position factors responsive to the registration signal are stored, in a memory, and updated in response to the registered signal. The sheet is registered at the transfer station so that the developed image is transferred to the sheet in registration.

Figure 1:
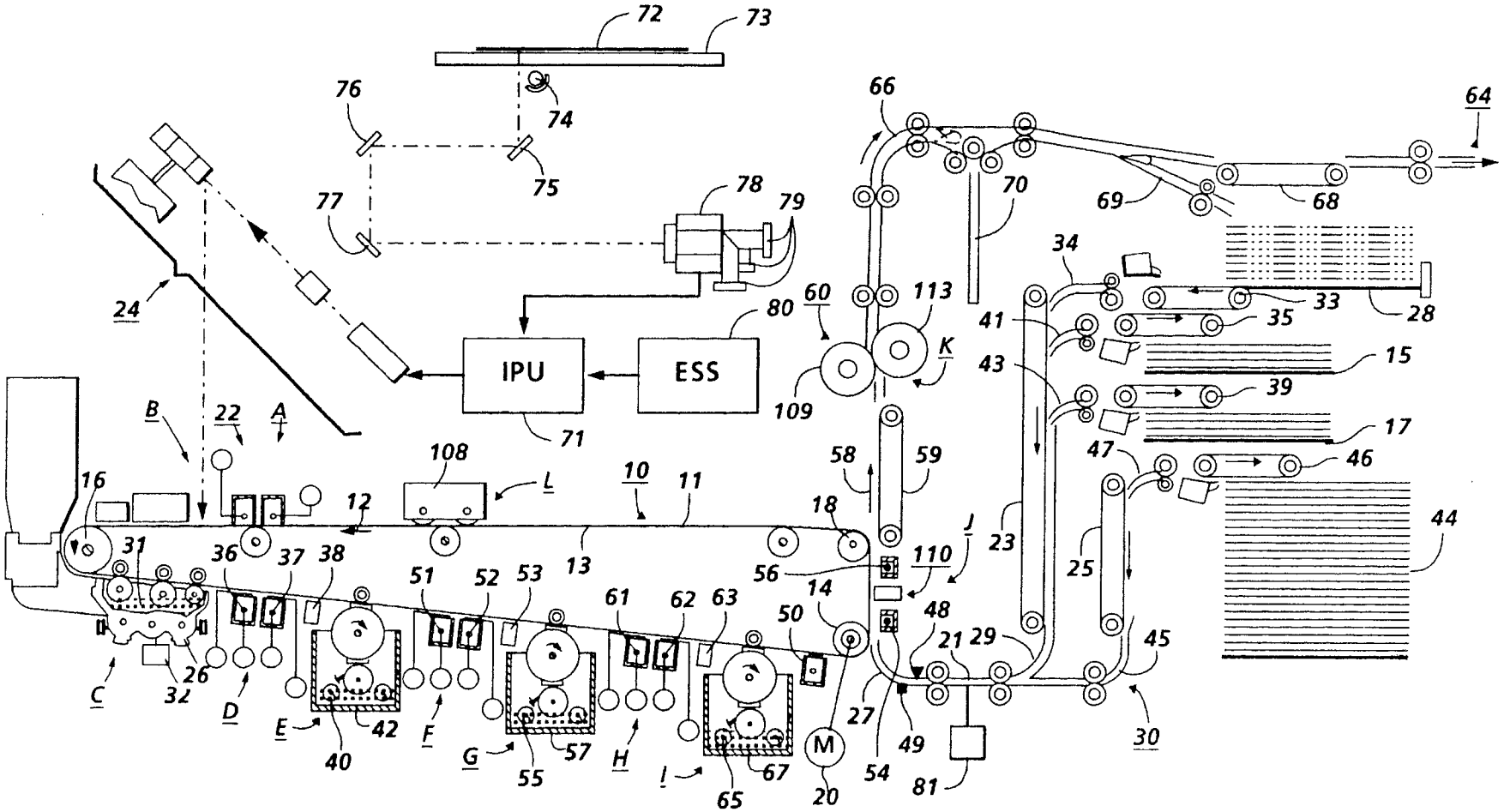
FIG. 1 is an elevational view of an illustrative printing machine incorporating the sheet to image registration system of the present invention therein.

For a general understanding of the features of the present invention, reference is made to the drawings. In the drawings, like reference numerals have been used throughout to designate identical elements. FIG. 1 schematically depicts the various elements of an illustrative color electrophotographic printing machine incorporating the sheet-to-image registration system of the present invention therein. It will become evident from the following discussion that this sheet-to-image registration system is equally well suited for use in a wide variety of printing machines and is not necessarily limited in its application to the particular embodiment depicted herein.

Turning now to FIG. 1, the color copy process typically involves a computer generated color image which may be conveyed to an image processor (IPU) 71, or alternatively a color document 72 may be placed on the surface of a transparent platen 73. A scanning assembly having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital two byte number which is proportional to the strength of the incident light. The digital signals represent each pixel (picture element) and are indicative of blue, green, and red densities. They are conveyed to the IPU 71 where they are formed into bit maps comprising yellow, cyan, magenta, and black. One skilled in the art will recognize that each bit map represents the exposure value for each pixel, the color component, and the color separation. The IPU 71 stores the bit maps for further instructions from an electronic subsystem (ESS) 80. The ESS is a self-contained, dedicated mini-computer having a central processor unit (CPU), electronic storage, and a display or user interface (UI). It is the control system which prepares and manages the image data flow between IPU 71 and a scanning device 24, as well as being the main multi-tasking processor for operating all of the other machine subsystems and printing operations to be described hereinafter. These operations include imaging, developing, sheet delivery and transfer, and various functions associated with subsequent finishing processes. Some or all of these subsystems may have micro-controllers that communicate with the ESS 80.

The printing machine employs a photoreceptor 10 in the form of a belt having a photoconductive surface layer 11 on an electroconductive substrate 13. Preferably the surface 11 is made from an organic photoconductive material. The substrate 13 is preferably made from an aluminum over coated polymer which is electrically grounded. Other suitable photoconductive surfaces and conductive substrates may also be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, a photoreceptor 10 passes through charging station A where a corona generating device, indicated generally by the reference numeral 22, charges photoreceptor 10 to a relatively high, substantially uniform potential. For purposes of example, photoreceptor 10 is negatively charged, however it is understood that a positively charged photoreceptor may be used by correspondingly varying the charge levels and polarities of the toners, recharge devices, and other relevant regions or devices involved in the color image formation process.

Next, the charged portion of photoreceptor 10 is advanced through an imaging station B. At imaging station B, the uniformly charged belt 10 is exposed to the scanning device 24 which causes the photoreceptor to be discharged in accordance with the output from the scanning device. The scanning device is a laser Raster Output Scanner (ROS). The ROS creates the image in a series of horizontal scan lines having a certain number of pixels per inch. It may include a laser with rotating polygon mirror blocks and a suitable modulator, or in lieu thereof, a light emitting diode array (LED) write bar. In addition to the image, the ROS writes target marks or indicia on the photoconductive surface. Preferably, the target marks are proceeding and/or adjacent to the image frame.

At a first development station C, a magnetic brush developer unit, indicated generally by the reference numeral 26 advances developer material 31 into contact with the latent image and latent target marks. Developer unit 26 has a plurality of magnetic brush roller members. These magnetic brush rollers transport negatively charged black toner material to the latent image and latent target marks for development thereof. Power supply 32 electrically biases developer unit 26.

At recharging station D, a pair of corona recharge devices 36 and 37 are employed for adjusting the voltage level of both the toned and untoned areas on photoreceptor 10 to a substantially uniform level. A power supply is coupled to each of the electrodes of corona recharge devices 36 and 37. Recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

Imaging devices 38, 53, and 63 are used to measure image registration on photoreceptor 10, and to superimpose subsequent images by selectively discharging the recharged photoreceptor. These imaging devices may include, for example, a LED image array bar, or another ROS. Image registration of this type is described in U.S. Pat. No. 5,394,223 issued to Hart et al. in February, 1995, the relevant portions thereof being hereby incorporated into the present invention. On skilled in the art will appreciate that imaging devices 38; 53, and 63 are controlled by ESS 80.

Imaging device 38 records a second electrostatic latent image on photoreceptor 10. A negatively charged developer material 40, for example, yellow toner, develops the second latent image. The toner is contained in a developer unit 42 disposed at a second developer station E and is transported to the second latent image recorded on the photoreceptor by a donor roll. A power supply (not shown) electrically biases the developer unit to develop this latent image with the negatively charged yellow toner particles 40.

At a second recharging station F, a pair of corona recharge devices 51 and 52 are employed for adjusting the voltage level of both the toned and untoned areas on photoreceptor 10 to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field.

A third latent image is recorded on photoreceptor 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, a pair of corona recharge devices 61 and 62 adjust the voltage level of both the toned and untoned areas on photoreceptor 10 to a substantially uniform level. A power supply is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field.

A fourth latent image is created using imaging device 63. The fourth latent image is formed on both bare areas and previously toned areas of photoreceptor 10 that are to be developed with the fourth color image. This image is developed, for example, using a cyan color toner 65 contained in developer unit 67 at a fourth developer station I. Suitable electrical biasing of the developer unit 67 is provided by a power supply, not shown.

Developer units 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system.

In order to condition the toner for effective transfer to a substrate, a negative pre-transfer corotron member 50 negatively charges all toner particles to the required negative polarity to ensure proper subsequent transfer.

A sheet of support material such as a sheet is advanced to transfer station J by a sheet feeding apparatus 30. During simplex operation (single sided copy), a blank sheet may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 each hold a different sheet type. Tray 15, for example, may feed 8.5×11 inch sheets, while tray 17 feeds 11×17 inch sheets, and high capacity tray 44 feeds 14.33×20.5 inch sheets. The speed of the sheet is adjusted at registration transport 21 so that the sheet arrives at transfer station J in synchronization with the image on the surface of photoconductive belt 10. Sheet registration of this type is described in U.S. Pat. No. 4,971,304 issued to Robert M. Loftus in November 1990, the relevant portions thereof being hereby incorporated into the present invention. Registration transport 21 receives a sheet from either a vertical transport 23 or a high capacity tray transport 25 and moves the received sheet to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

The pretransfer baffle 27 guides the sheet from the registration transport 21 to transfer station J. Pretransfer baffle 27 is isolated from machine ground to prevent the discharge of photoreceptor 10. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which sprays positive ions onto the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 of the present invention is located in the gap between the transfer and corona devices 54 and 56. Sheet-to-image detector 110 senses variations in actual sheet to image registration and provides signals indicative thereof to ESS 80 and controller 81 while the sheet is still tacked to photoreceptor belt 10.

After transfer, the sheet continues to move, in the direction of arrow 58, onto a conveyor 59 which advances the sheet to fusing station K. Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the toner powder images are permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed at cleaning station L using a cleaning brush structure contained in a housing 108.

FIG. 1 illustrates an example of a printing machine having the sheet to image registration of the present invention therein to produce a visible image on image color output in a single pass or rotation of the photoreceptor. However, it is understood that the sheet to image registration of the present invention may be used in a multiple pass color image formation process. In a multi-pass system, each successive color image is applied in a subsequent pass or rotation of the photoreceptor. Furthermore, only a single set of charging devices is needed to charge the photoreceptor surface prior to each subsequent color image formation. For purposes of simplicity, both charging devices can be employed for charging the photoreceptor using the split recharge concept as hereinbefore described, prior to the exposure of each color toner latent image. Alternatively, a controller could be used to regulate the charging step so that only a single recharge device is used to charge the photoreceptor to the desired voltage level for exposure and development thereon. Also, only a single exposure device is needed to expose the photoreceptor prior to each color image development. Finally, in a multi-pass system, the cleaning station is of the type that is capable of sliding away from the surface of the photoreceptor during the image formation process, so that the image is not disturbed prior to image transfer.

The FIG. 1 color printing machine requires that the sheet to image registration be within approximately plus or minus 250 microns for side 1 to side 2 image registration on the copy delivered at output 64. Accordingly, sheet registration alone will use one half of this value or about plus or minus 125 microns with the remainder being divided up between transferring the sheet to photoreceptor 10 from baffle 27, as well as registering the image to photoreceptor 10. An important parameter for sheet registration at registration transport 21 is the drive force on the sheet. This drive force must be greater than the sheet drag force, but not so great as to damage the sheet. Many variables including: sheet friction, sheet beam strength, nip force, contamination, and temperature affect the sheet drive force. Consequently, any changes impacting the sheet drive force will ultimately affect the side 1 to side 2 image registration. A wide variety of sheet types processed through the printing machine broaden the range of sheet frictions and beam strength that the registration system must handle. Cut tolerance of the sheet also affects the side 1 to side 2 image registration. Sheet cut squareness may vary as much as plus or minus 750 microns, which is three times the side 1 to side 2 image registration tolerance. Thus, it is desirable to have a sheet to image registration system that can dynamically detect and control misregistrations so as to maintain the side 1 to side 2 registration tolerance. Variations in registration, at registration transport 21, may be caused by: changes in the diameter of the registration rolls due to wear, replacement or piece part variation, inboard to outboard variations of the photoreceptor belt 10 due to conicity associated with replacement, transfer contact point differences due to sheet thickness, beam strength, baffle to sheet friction and curl, the thermal expansion of baffles and frame members, changes in sensor trip points due to dirt, drift, or differences in sheet opacity, and other component replacements such as registration rolls and the pretransfer baffle. All of these have to be accounted for to achieve a tightly controlled sheet to image registration. The control provided by the sheet-to-image registration system of the present invention occurs dynamically, in real-time operation over the life of the machine. Additionally, the system may be used during final testing of the machine, at the manufacturing site, to setup registration in lieu of older methods employing original test documents having registration targets thereon. The sheet-to-image registration system of the present invention will now be discussed in further detail with reference to FIGS. 2 through 11.

Figure 2:
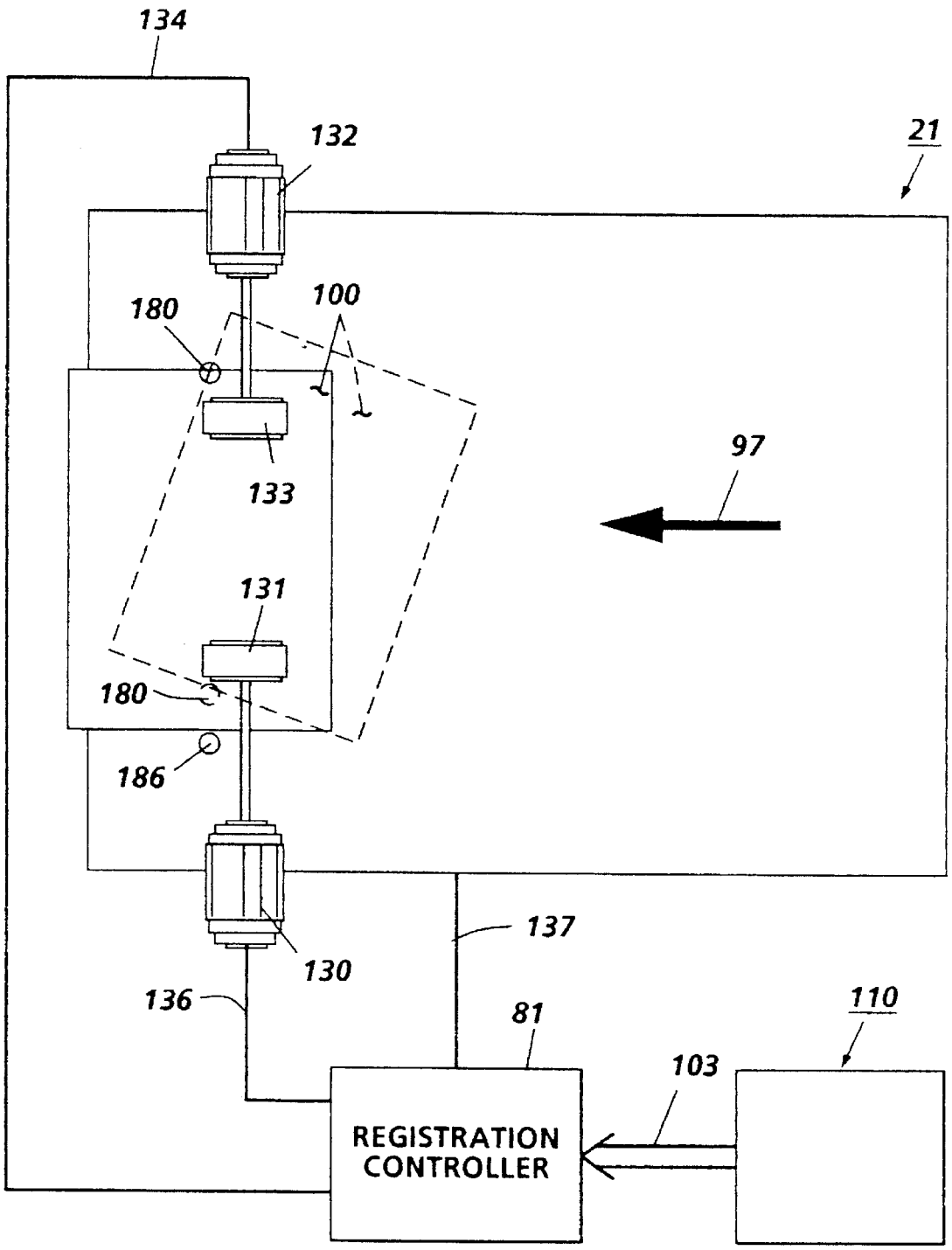
FIG. 2 is a plan view of an edgeless registration transport.

FIG. 2 shows an an edgeless registration transport 21. Registration transport 21 includes sheet drive rolls 131 and 133 which are driven independently by two differential drive servo motor encoders 130 and 132, respectively. Edgeless registration systems are well known and disclosed in U.S. Pat. No. 4,971,304, the pertinent portions of which are incorporated herein by reference. Transport 21 initially detects and corrects for skew and relative position of a received sheet 100 before it is delivered to photoreceptor 10 (shown in FIG. 1). Detection is achieved by using a pair of lead edge sensors 180 and a side edge sensor 186. Lead edge sensors 180 and side edge sensor 186 are connected to registration controller 81 via conductor 137. When processing the first side (simplex side) or the second side (duplex side) of sheet 100, in a process direction 97, sensor pair 180 detects the lead edge of sheet 100. Lead edge sensors 180 provide skew information to registration controller 81 until sensor 186 signals the registration controller 81 of an edge registered condition. Until a signal from sensor 186 is received, registration controller 81 processes the information so as to control differential motors 130 and 132 via conductors 136 and 134. Motors 130 and 132 correct the skew by correspondingly driving a pair of rolls 131 and 132 so that the lead edge of sheet 100 meets the lead edge of a toner image (not shown) traveling on photoreceptor 10 at transfer station J (shown in FIG. 1). At transfer station J, detector 110 again measures the alignment of sheet 100 to the image on photoreceptor 10. This information is communicated to registration controller 81 via data path 103. The registration controller 81 now processes the information received from detector 110. If skew and/or offset are present in the alignment of sheet 100 to the image, registration controller 81 corrects the condition by independently changing the appropriate drive parameters on the registration transport 21 for subsequent sheets.

Figure 3:
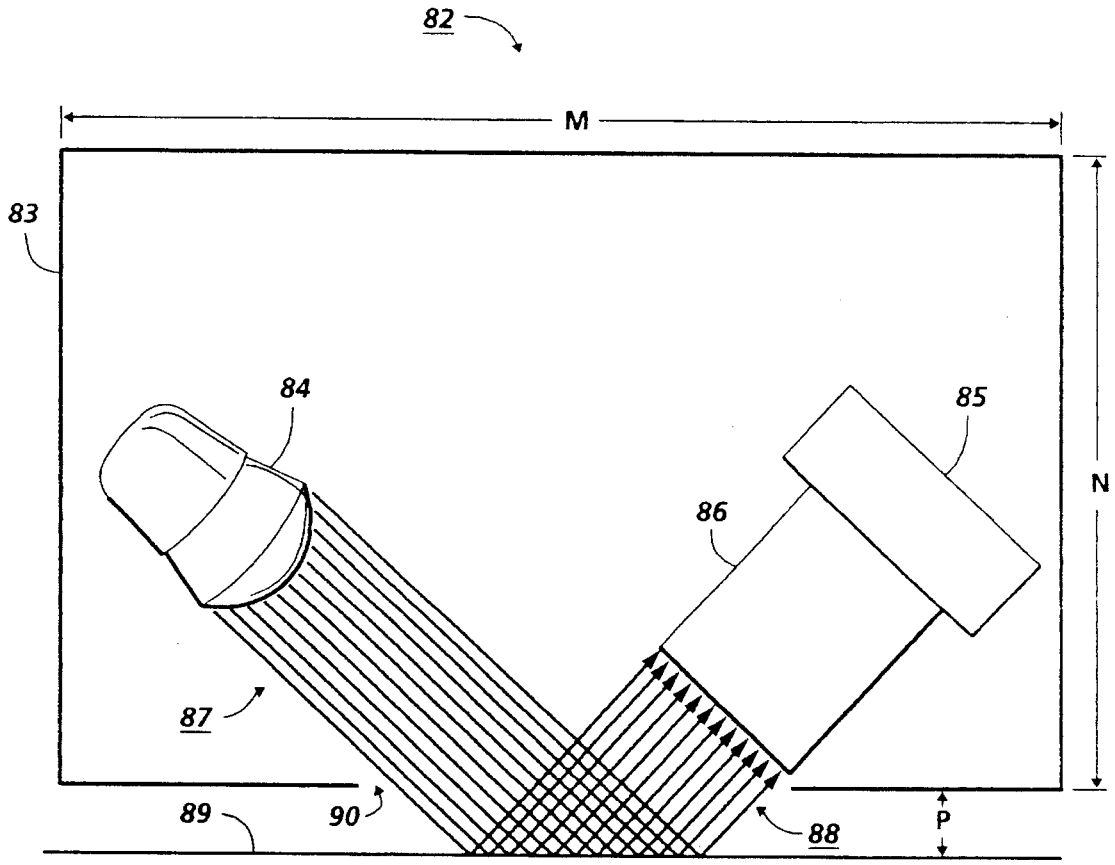
FIG. 3 is a schematic elevational view showing a sensor used in the sheet to image registration system of the FIG. 1 printing machine.

FIG. 3, shows a sensor assembly suitable for the sheet-to-image registration detector. Sensor assembly 82 includes a housing 83 having a width dimension M of approximately 14 millimeters and a height dimension N of approximately 25 millimeters. Housing 83 contains a light source 84 such as a light emitting diode (LED), a focusing light optics lens (selfoc lens) 86 consisting of fiber optics with a radially graded refractive index array, and a detector 85. Selfoc lens 86 serves to concentrate a specular light component 88 onto the capture area of detector 85. Detector 85 may be a reflective type CCD linear image sensor, or a reflective type single point phototransistor. In operation, a light beam 87 emitted by light source 84 passes through aperture 90 on housing 83 to strike a surface 89. Sensor 82 is positioned above surface 89 at dimension P that is approximately 5 millimeters in height. The specular light component 88, which is the portion of light beam 87 reflected by surface 89, is reflected at an angle equal to the angle of incidence according to the reflectivity of surface 89 (Snell's law). Since detector 85 has a limited depth of field, selfoc lens 86 provides the best focus for the distance existing between surface 89 and detector 85. Detector 85 thereafter senses the reflected light concentrated at its capture area and generates a corresponding electrical output signal. One skilled in the art will recognize that the detector comprised of a CCD array will view a greater surface area than a single point phototransistor. The CCD array may view a maximum width of approximately one inch and have a resolution of 2048 dots per inch with each dot approximating 0.5 mils. Each pixel element in the CCD is also capable of generating a digital signal value ranging between 0 and 255 decimal depending upon the amount of received light (a mirror surface yielding 255 for full reflectance and 0 representing complete absorption). In this way, the CCD array can detect the surface 89 that comprises a sheet of paper or a color image deposed on a photoreceptor. The resolution of the phototransistor may be equal to a tolerance of about plus or minus 0.5 mils when viewed through an aperture having dimensions approximating 3 millimeters by 0.12 millimeters.

Figure 4:
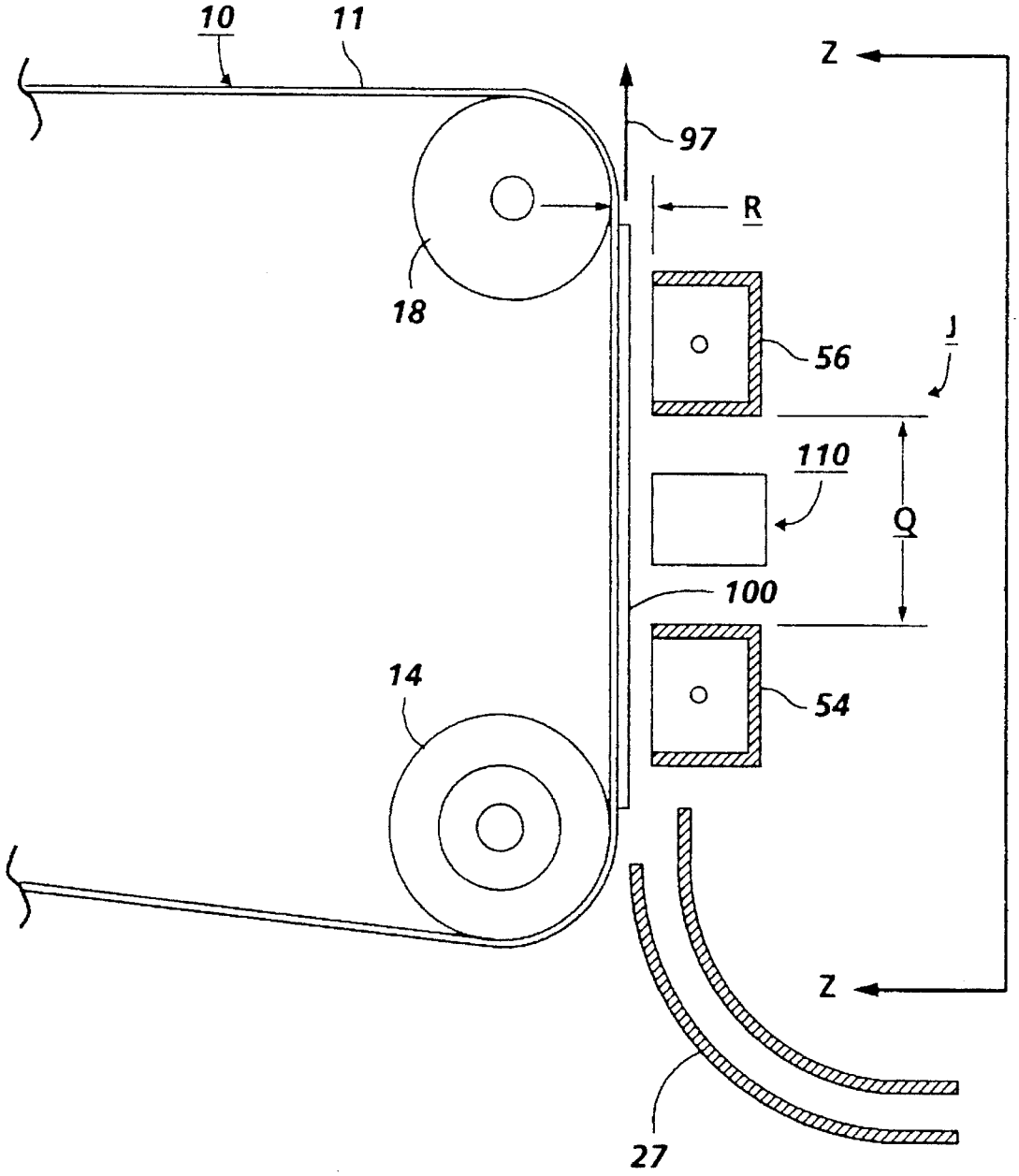
FIG. 4 is an enlarged schematic elevational view showing the placement of a sheet-to-image registration detector in the image transfer zone of the FIG. 1 printing machine.

FIG. 4 is an enlarged schematic view showing the placement of the sheet-to-image registration detector 110 in the image transfer zone J of the FIG. 1 printing machine. Detector 110 is positioned in an approximately 16 millimeter wide gap Q formed between the transfer corotron 54 and detack corotron 56. The detector 110 is fixedly mounted above photoreceptor 10, at a distance R, and parallel thereto. The minimum spacing required at R is approximately 5 millimeters. Photoreceptor 10 also has a sheet 100 tacked thereon at transfer station J, wherein both photoreceptor 10 and sheet 100 move in a process direction indicated by arrow 97.

Figure 5:
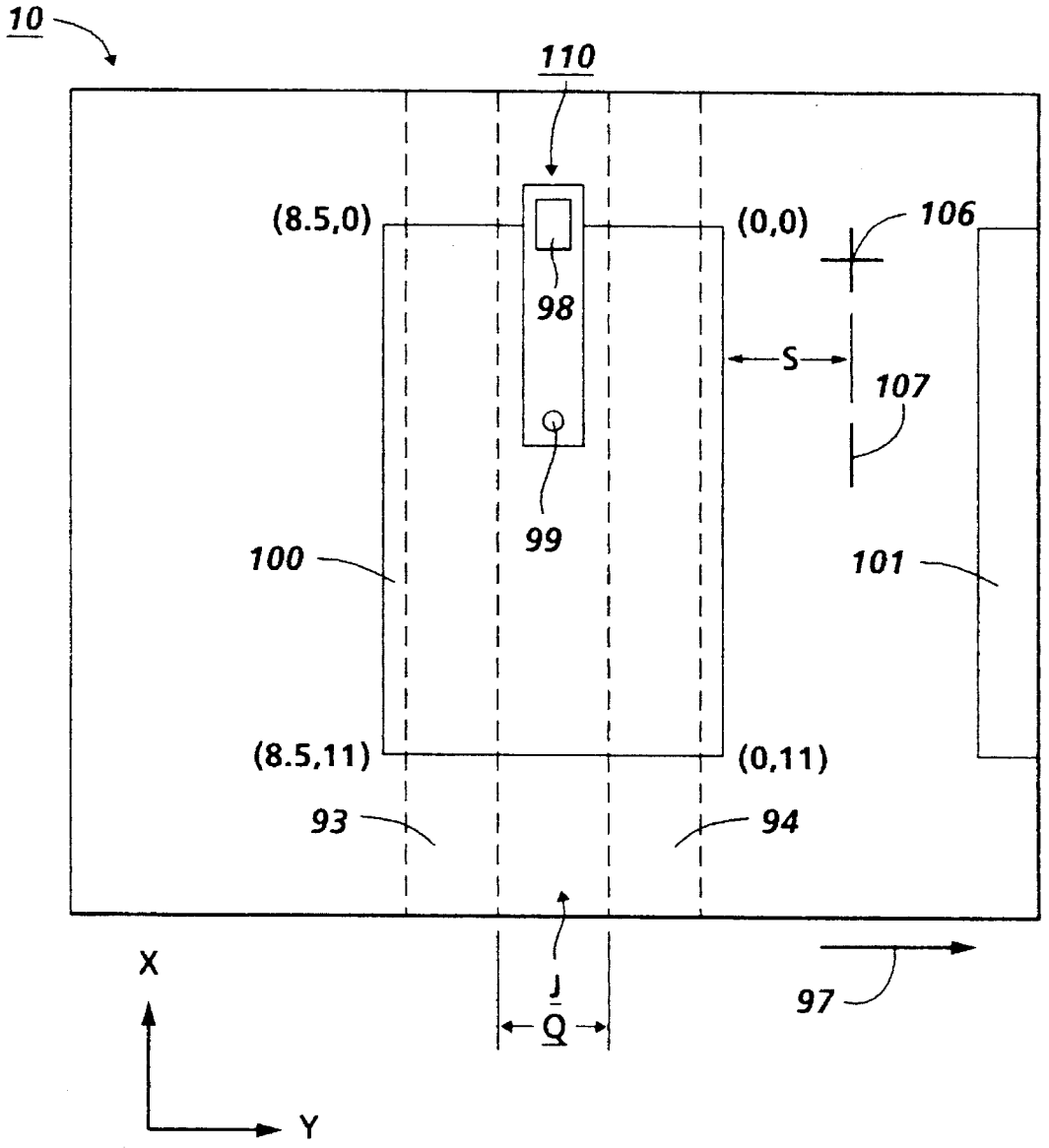
FIG. 5 is a plan view of the sheet-to-image registration detector position in the image transfer zone.

Turning to FIG. 5, there is shown a plan view of the location of detector 110 in the image transfer zone J. Again, the position of detector 110 is in the gap Q found between transfer zone 93 and detack zone 95. Detector 110 has two sensor assemblies 82 of the type discussed previously with reference to FIG. 2. Sensor 98 has a CCD array contained therein, while sensor 99 contains a single point phototransistor. Two latent target marks 106 and 107 are written on photoreceptor 10 by ROS 24 (FIG. 1) and subsequently toned at developer stations C, E, G, and I (FIG. 1). Target marks are well known and disclosed in U.S. Pat. No. 5,394,223, the pertinent portions of which are incorporated herein by reference. Target marks 106 and 107 reside in the interdocument area between sheets 100 and 101. The distance separating the lead edge of sheet 100 from targets 106 and 107 is approximately 0.5 inches as indicated by dimension S. Mark 106 comprises a cross hair target and mark 107 is a single, vertical line positioned adjacently to mark 106 on an axis perpendicular to the process direction indicated by arrow 97. Assuming that sheet 100 is a piece of 8.5×11 inch stock, its corners are identified by (0, 0), (8.5, 0), (8.5, 11), and (0, 11) to indicate the inboard/leading edge, inboard/trailing edge, outboard/trailing edge, and the outboard/leading edge respectively. The corners of other sheet sizes may be identified similarly. For example (0, 0), (11, 0), (11, 17), and (0, 17) identify the corners of a piece of 11×17 inch stock. In FIG. 5, it is is further assumed that sheet 100 is in registration with a toned image (not shown)located thereunder on photoreceptor 10. Thus, in FIG. 5, the corners of sheet 100 correspond to the corners of the toned image.

Detector 110 senses a common physical edge of a sheet when calculating a sheet's distance from a toner image at transfer station J. For a simplex (front side) pass, sensors 98 and 99 measure the lead edge of a sheet between corners (0, 0) and (0, 11) with reference to target marks 106 and 107 and the sheet's trail edge on its duplex (back side) pass. The combination of sensors 98 and 99 detect skew, while detector 98, alone senses offset. Alternatively, the advantages of the present invention could be realized by detecting the trail edge of a simplex sheet and a lead edge of a duplex sheet. Regardless, sheet-to-image registration reduces the occurrence of side 1 to side 2 registration errors due to variances in sheet size. For example, while machine side 1 to side 2 registration tolerances may be ±0.30 millimeters, sheet cutting tolerances may be ±0.75 millimeters. Thus, using detector 110 to measure sheet-to-image registration, in a duplex system, avoids up to 1.40 millimeter of offset between the front and back images on subsequent sheets passing through transfer station J.

Figure 6:
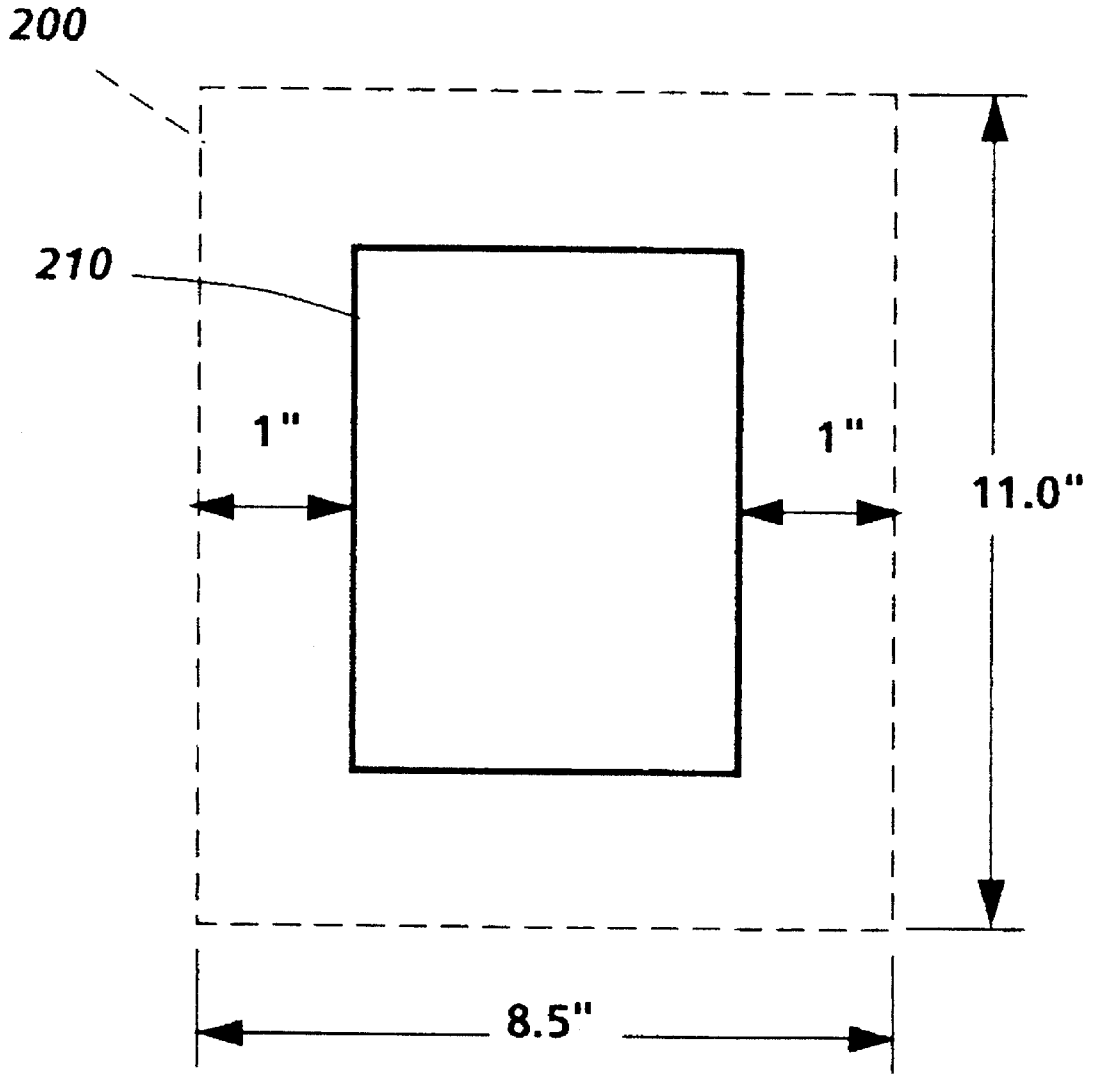
FIG. 6 is a is an illustrative example of an image traveling on a photoconductive belt before transfer to a sheet at an image transfer station.

FIG. 6 represents an image frame 200 traveling on a photoreceptor towards a transfer station. The image frame 200 has dimensions 8.5"×11" and includes imagable toner object 210. The imagable toner object 210 is a rectangle with dimensions 6.5"×9" and located in the center of the 8.5"×11"image frame 200. Assume that imagable toner object 210 will be transferred in duplicate to both the front and back of a sheet 100.

Figure 7:
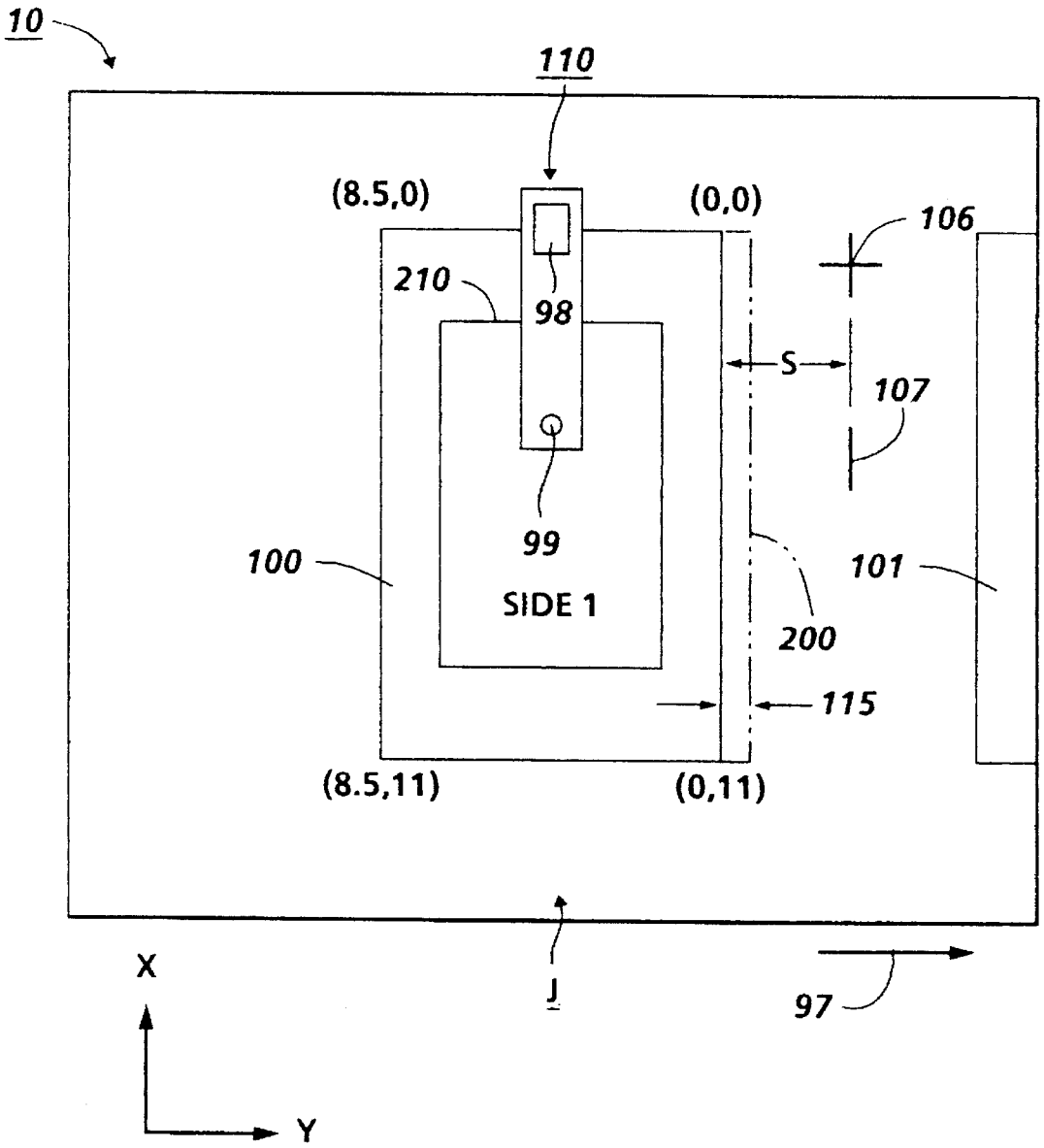
FIG. 7 is a is an illustrative example of the first side of a sheet traveling in a process direction after receiving the image shown in FIG. 6.
Figure 8:
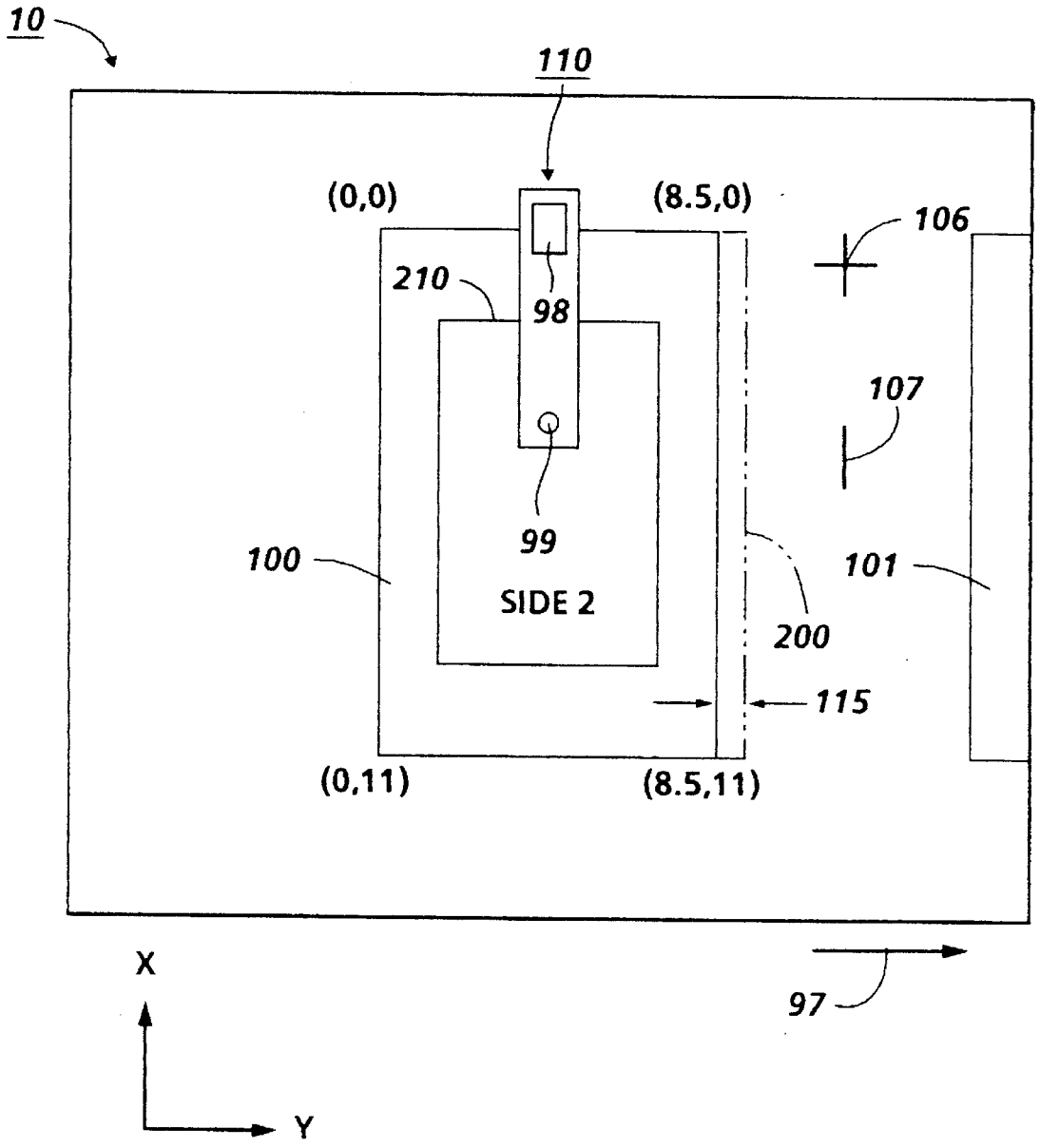
FIG. 8 is an illustrative example of the second side of the sheet shown in FIG. 7 after receiving the image shown in FIG. 6.
Figure 9:
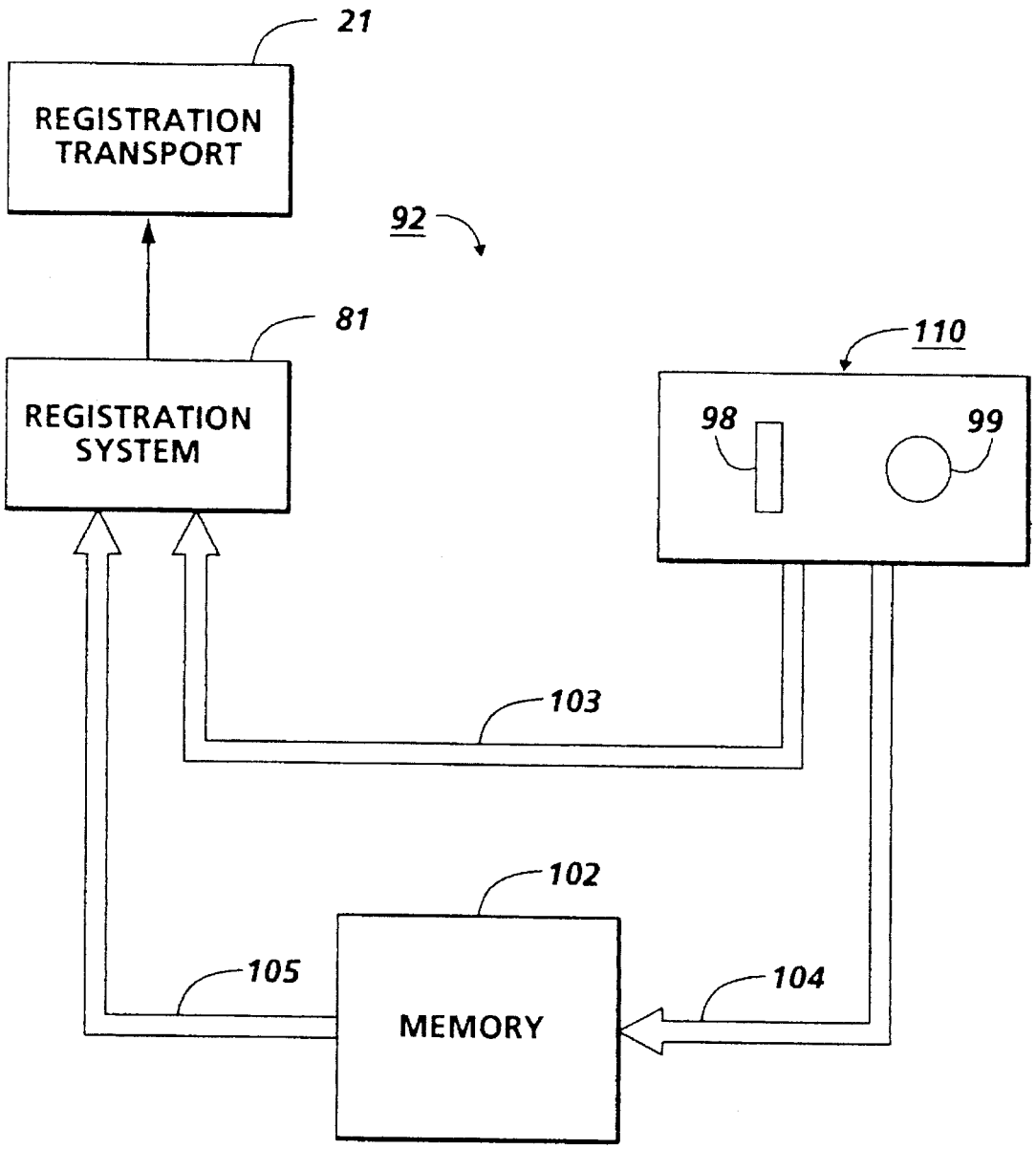
FIG. 9 is a block diagram of a control system for the sheet to image registration system.

With reference to FIGS. 7, 8, and 9, FIG. 7 illustrates transfer station J having sheet 100 and image frame 200 traveling in process direction 97. Specifically, sheet 100 does not have exactly the dimensions of 8.5×11 inches. Due to imprecise sheet cut tolerances, the width of sheet 100 is 1.0 mm short. The 1.0 mm variance results in an image offset 115 at the lead edge, of the front (simplex) side, of sheet 100 between corners (0,0) and (0, 11). The offset is sensed by the point sensor 99 in detector 110.

The reflectance of toner is different than the reflectance of paper. By setting the reflectance thresholds on the CCD sensor 98, both paper and toner can be sensed and distinguished from each other. Referring to FIG. 7, as the toner image target 106 passes under the CCD sensor 98 wherein, the intersection point of the horizontal and vertical lines is determined. The intersection point of target 106 is at a known location relative to image frame 200 corner (0,0). After the intersection point of target is read by CCD sensor 106, the threshold point of CCD sensor 106 is changed so that it will sense only paper and not toner. This prevents the CCD sensor from sensing any toner which must be ignored and only the (0,0) of the paper is read by the CCD sensor. Once the paper position is read, the exact amount of paper to image misregistration can be determined and correction to the next sheet can be made.

Although sheet skew is not present in the example of FIG. 7, it is detectable by the working combination of sensors 98 and 99. Referring back to FIG. 7, the distance S between the lead edge of sheet 100 and target mark 107 is measured. The measurement is initialized as target mark 107 passes under the single point phototransistor of sensor 99 and triggers a counting sequence. Pulses generated by the encoder (not shown) attached to the photoreceptor 10 drive motor (not shown) are counted until sensor 99 detects the lead edge of sheet 100 to terminate the count. The pulses accumulated between the start and end of the count establish the location of a first point in the skew measurement.

Turning now to FIG. 8, FIG. 8 represents the second (duplex) side of sheet 100, traveling in process direction 97, with image frame 200 containing image 210 thereon. For the side two pass, the paper 100 will be registered to the trail edge of the image frame (0,0) and (0, 11). Misregistration will be sensed by counting the encoder pulses between target 106 and line 107 relative to edge (0,0) and (0, 11) of sheet 100. After imaging, sheet cut tolerance offset 115 is shifted to the trail edge between corners (8.5, 0) and (8.5, 11) on the back (duplex) side of sheet 100. Thus, the sheet to image registration shifts image offset to a common edge of sheet 100, thereby eliminating misregistration due to sheet cut tolerances. After the correction, portions of image 200 are cropped which fall outside the boundary formed by the lead and trailing edge.

Referring to FIG. 9, there is shown the control arrangement of the present invention. To summarize, the sheet-to-image detector 110 communicates digital information back to registration controller 81 and a look up table 102. The look up table 102 may reside in a portion of the machine memory (not shown). Information conveyed by detector 110 to registration controller 81 flows along a data path 103. The information includes the lead edge location on the front side of the copy and trail edge information for the back side. Registration controller 81 processes the information received via path 103 to determine the presence of sheet skew and offset. If there is skew and/or offset, registration controller 81 corrects the skew and or/offset by changing drive parameters on registration transport 21.

Additionally, information conveyed by detector 110 to the memory look up table 102 flows along a data path 104. Since major variations in registration may occur whenever the sheet lot is changed, look up table 102 stores sheet correction factors for each sheet type stored in their respective storage trays (i.e. trays 15, 17, and 44 in FIG. 1). Both front and back side values are stored and include lateral, process and skew components according to the sheet type. The correction factors are provided, on demand, to registration controller 81 via a data path 105 prior to the arrival of a sheet at the registration transport 21. The updated correction factors, for each tray, are based upon raw data concerning sheet cut squareness sensed by CCD sensor 98 and point sensor 99 and averaged over the last 25 sheets feed from a given tray.

In recapitulation, the present invention is directed to an apparatus for sheet to image registration for a printing machine. The registration system accurately tracks sheet-to-image registration in the process and lateral directions, and skew position when the sheet is tacked to a photoreceptor having an image developed thereon. Performance degradation is detected and transmitted back to either the sheet registration system. Registration correction factors are also provided to the sheet registration system by a continuously updated memory look up table so as to compensate for errors caused by aging or replaced components.

It is, therefore, evident that there has been provided, in accordance with the present invention, an apparatus for sheet-to-image registration that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall are within the spirit and broad scope of the appended claims.

We claim:

1. An apparatus for registering a sheet with a developed image on a moving surface, including:

a transfer station;

a detector located at said transfer station, said detector being responsive to an edge of the sheet and a registration portion of the developed image for generating a registration signal;

a memory for storing sheet position factors, said memory being responsive to the registration signal from said detector for updating the sheet position factors; and a registration transport, in communication with said detector and said memory, for moving the sheet to said transfer station in registration with the developed image.

2. An apparatus for registering a sheet with a developed image on a moving surface, including:

a transfer station;

a detector located at said transfer station, said detector being responsive to an edge of the sheet and a registration portion of the developed image for generating a registration signal wherein the registration portion of the developed image includes a cross target registration mark and a line registration mark with the line registration mark being adjacent the cross target registration mark and extending in a direction transverse to the direction of movement of the surface;

a memory for storing sheet position factors, said memory being responsive to the registration signal from said detector for updating the sheet position factors; and a registration transport, in communication with said detector and said memory for moving the sheet to said transfer station in registration with the developed image.

3. An apparatus according to claim 2, wherein said detector includes a first sensor unit comprising a CCD array for sensing the cross target registration mark to measure the registration of a non-registration portion of the developed image to the sheet edge.

4. An apparatus according to claim 3, wherein said first sensor unit includes:

a housing;

a light source, located in said housing, for emitting light rays incident to the sheet and the developed image; and a lens, disposed in said housing, for focusing light rays reflected from the sheet and developed image onto said CCD array disposed in said housing.

5. An apparatus according to claim 3, wherein said detector further includes a second sensor unit having a phototransistor for sensing the line registration mark, said CCD array and said phototransistor measuring the registration between the sheet edge and the non-registration portion of the developed image.

6. An apparatus according to claim 5, wherein said second sensor unit includes:

a housing;

a light source, located in said housing, for emitting light rays incident to the sheet and the developed image; and a lens, disposed in said housing, for focusing light rays reflected from the sheet and developed image onto said phototransistor disposed in said housing.

7. An apparatus according to claim 2, wherein said transfer station includes:

a first corona generator; and a second corona generator with said detector being interposed between said first corona generator and said second corona generator.

8. A printing machine of the type in which a sheet is registered with a developed image on a moving surface, wherein the improvement includes:

a transfer station;

a detector located at said transfer station, said detector being responsive to an edge of the sheet and a registration portion of the developed image for generating a registration signal;

a memory for storing sheet position factors, said memory being responsive to the registration signal from said detector for updating the sheet position factors; and a registration transport, in communication with said detector and said memory, for moving the sheet to said transfer station in registration with the developed image.

9. A printing machine of the type in which a sheet is registered with a developed image on a moving surface, wherein the improvement includes:

a transfer station;

a detector located at said transfer station, said detector being responsive to an edge of the sheet and a registration portion of the developed image for generating a registration signal wherein the registration portion of the developed image includes a cross target registration mark and a line registration mark with the line registration mark being adjacent the cross target registration mark and extending in a direction transverse to the direction of movement of the surface;

a memory for storing sheet position factors, said memory being responsive to the registration signal from said detector for updating the sheet position factors; and a registration transport, in communication with said detector and said memory for moving the sheet to said transfer station in registration with the developed image.

10. A printing machine according to claim 9, wherein the detector includes a first sensor unit comprising a CCD array for sensing the cross target registration mark to measure the registration of a non-registration portion of the developed image to the sheet edge.

11. A printing machine according to claim 10, wherein said first sensor unit further includes:

a housing;

a light source, located in said housing, for emitting light rays incident to the sheet and the developed image; and a lens, disposed in said housing, for focusing light rays reflected from the sheet and developed image onto said CCD array disposed in said housing.

12. A printing machine according to claim 10, wherein said detector further includes a second sensor unit having a phototransistor for sensing the line registration mark, said CCD array and said phototransistor measuring between the sheet edge and the non-registration portion of the developed image.

13. A printing machine according to claim 12, wherein said second sensor unit includes:

a housing;

a light source, located in said housing, for emitting light rays incident to the sheet and the developed image; and a lens, disposed in said housing, for focusing light rays reflected from the sheet and developed image onto said CCD array disposed in said housing.

14. A printing machine according to claim 9, wherein said transfer station includes:

a first corona generator; and a second corona generator with said detector being interposed between said first corona generator and said second corona generator.

15. A method of registering a sheet with a developed image on a moving surface, including:

moving the sheet to a transfer station;

detecting an edge of the sheet and a registration portion of the developed image at the transfer station, said detecting step generating a registration signal;

storing sheet position factors responsive to the registration signal in a memory, said storing step updating the sheet position factors; and registering the sheet at the transfer station in response to the registration signal and the stored sheet position factors, so that the developed image is transferred to the sheet in registration.

16. A method of registering a sheet with a developed image on a moving surface, including:

moving the sheet to a transfer station;

detecting an edge of the sheet and a registration portion of the developed image at the transfer station, said detecting step generating a registration signal;

providing the registration portion as a cross target registration mark and a line registration mark with the line registration mark being adjacent the cross target registration mark and extending in a direction transverse to the direction of movement of the surface;

storing sheet position factors responsive to the registration signal in a memory, said storing step updating the sheet position factors; and registering the sheet at the transfer station in response to the registration signal and the stored sheet position factors, so that the developed image is transferred to the sheet in registration.

17. A method according to claim 16, wherein said detection step includes:

sensing the cross target registration mark; and measuring the registration of a non-registration portion of the developed image to the sheet edge.

18. A method according to claim 17, wherein said step of sensing the cross target registration mark includes:

emitting light rays incident to the sheet and the developed image; and focusing light rays reflected from the sheet and developed image onto a CCD array.

19. A method according to claim 17, wherein said detecting step includes:

sensing the line registration mark; and measuring the registration between the sheet edge and the non-registration portion of the developed image.

20. A method according to claim 18, wherein said step of sensing the line registration mark includes:

emitting light rays incident to the sheet and the developed image; and focusing light rays reflected from the sheet and developed image onto a phototransistor.

* * * * *